US006820689B2

(12) United States Patent
Sarada

(10) Patent No.: US 6,820,689 B2
(45) Date of Patent: Nov. 23, 2004

(54) METHOD AND APPARATUS FOR GENERATING POLLUTION FREE ELECTRICAL ENERGY FROM HYDROCARBONS

(75) Inventor: Steven A. Sarada, Englewood, CO (US)

(73) Assignee: Production Resources, Inc., Englewood, CO (US)

( * ) Notice: Subject to any disclaimer, the term of this patent is extended or adjusted under 35 U.S.C. 154(b) by 0 days.

(21) Appl. No.: 10/199,430

(22) Filed: Jul. 18, 2002

(65) Prior Publication Data

US 2004/0011523 A1 Jan. 22, 2004

(51) Int. Cl.[7] ..... E21B 43/18; E21B 43/16

(52) U.S. Cl. ..... 166/266; 166/267; 166/244.1; 166/401

(58) Field of Search ..... 166/267, 266, 166/244.1, 401, 269; 60/39.12, 39.5, 39.52

(56) References Cited

U.S. PATENT DOCUMENTS

| | | | | |
|---|---|---|---|---|
| 3,918,521 A | * | 11/1975 | Snavely et al. | 166/272.3 |
| 4,007,786 A | * | 2/1977 | Schlinger | 166/266 |
| 4,014,575 A | * | 3/1977 | French et al. | 299/2 |
| 4,037,655 A | * | 7/1977 | Carpenter | 166/248 |
| 4,043,393 A | * | 8/1977 | Fisher et al. | 166/248 |
| 4,044,830 A | | 8/1977 | Van Huisen | 166/267 |
| 4,057,736 A | * | 11/1977 | Jeppson | 307/78 |
| 4,160,479 A | * | 7/1979 | Richardson et al. | 166/267 |
| 4,169,506 A | * | 10/1979 | Berry | 166/256 |
| 4,546,829 A | * | 10/1985 | Martin et al. | 166/267 |
| 4,679,626 A | * | 7/1987 | Perkins | 166/248 |
| 4,699,719 A | | 10/1987 | Finley | 210/742 |
| 5,055,030 A | | 10/1991 | Schirmer | 431/10 |
| 5,247,791 A | | 9/1993 | Pak et al. | 60/39.182 |
| 5,335,728 A | | 8/1994 | Strahan | 166/267 |
| 5,454,666 A | | 10/1995 | Chaback | 405/52 |
| 5,463,165 A | | 10/1995 | Northrop | 588/250 |
| 5,605,193 A | | 2/1997 | Bearden et al. | 166/370 |
| 5,694,772 A | | 12/1997 | Weinberg et al. | 60/641.2 |
| 5,724,805 A | | 3/1998 | Golomb et al. | 60/39.02 |
| 5,771,973 A | | 6/1998 | Jensen et al. | 166/303 |
| 5,906,806 A | | 5/1999 | Clark | 423/437.1 |
| 5,956,937 A | * | 9/1999 | Beichel | 60/39.17 |
| 6,032,737 A | | 3/2000 | Brady et al. | 166/265 |
| 6,073,695 A | | 6/2000 | Crawford et al. | 166/303 |
| 6,119,778 A | | 9/2000 | Seidle et al. | 166/263 |
| 6,137,028 A | | 10/2000 | Snow | 588/250 |
| 6,138,758 A | | 10/2000 | Shaw et al. | 166/265 |
| 6,148,602 A | | 11/2000 | Demetri | 60/39.05 |
| 6,155,047 A | | 12/2000 | Streetman | 60/398 |
| 6,170,264 B1 | | 1/2001 | Viteri et al. | 60/671 |
| 6,189,614 B1 | | 2/2001 | Brady et al. | 166/266 |
| 6,196,000 B1 | | 3/2001 | Fassbender | 60/649 |
| 6,207,120 B1 | | 3/2001 | Belmonte et al. | 423/210 |
| 6,216,463 B1 | | 4/2001 | Stewart | 60/641.2 |
| 6,235,091 B1 | | 5/2001 | Spencer | 96/242 |
| 6,269,624 B1 | | 8/2001 | Frutschi et al. | 60/39.02 |
| 2001/0000049 A1 | | 3/2001 | Kataoka et al. | 60/39.05 |

OTHER PUBLICATIONS

"Microturbines: Powerful Potential", Oct. 1999, Article.

"A Working Paper for Road Mapping Future Carbon Sequestration R & D", Feb. 1999, Virginia Tech Research Div.

(List continued on next page.)

*Primary Examiner*—David Bagnell
*Assistant Examiner*—Shane Bomar
(74) *Attorney, Agent, or Firm*—Sheridan Ross P.C.

(57) ABSTRACT

The present invention relates to the generation of substantially pollution free energy by utilizing hydrocarbons to create electrical energy for interconnection to local transmission lines positioned between an electrical generating facility and an end user, while re-injecting exhaust fumes or other byproducts into a subterranean formation.

20 Claims, 6 Drawing Sheets

OTHER PUBLICATIONS

"Carbon Sequestration: A Third Approach to Carbon Management", U.S. Department of Energy Report, Nov. 29, 2001.

Hamaker, R.J., "Surface Facilities for Inert Gas Generation and Compression East Binger Unit, Caddo County, OK", Feb. 1979.

Emmons, Fred R. et al., "Nitrogen Management at the East Binger Unit Using an Integrated Cryogenic Process", Oct. 1986.

Mills, M.P., "A Stunning Regulatory Burden: The EPA Designating CO2 as a Pollutant", Aug. 16, 2000.

Gunter, W.D. et al., "Deep Coalbed Methane in Alberta, Canada: A Fuel with the Potential of Zero Greenhouse Gas Emissions". Energy Conversion and Management, vol. 38, 1997.

Wong, S., et al., "Economics of CO2 Sequestration in Coalbed Methane Reservoirs", Society of Petroleum Engineers, Apr. 2000.

Wong, S., et al., "Economics of Flue Gas Injection and CO2 Sequestration in Coalbed Methane Reservoirs". Fifth International Conference on GHG Control Technologies. Aug. 2000.

"Capture & Storage of CO2". Third International Conference on Carbon Dioxide Removal—IEA Greenhouse Gas R&D Programme, Sep. 1996.

"Petroleum Production in Nontechnical Language—Second Edition", Forest Gray; PennWell Publishing Company, 1995, pp. 87–100, 171–181, 211–221.

"Distributed Generation: A Nontechnical Guide", Ann Chambers; PennWell Corporation, 2001, pp. 13–19, 49–70.

"Power Primer: A Nontechnical Guide form Generation to End Use", Ann Chambers; PennWell Publishing Company, 1999, pp. 7–14, 71–75, 77–82, 121–126.

"Engineering Data Book", Gas Processors Association, $11^{th}$ Edition, 1998, Sections 3, 6, 7, 10, 13.

* cited by examiner

METHOD AND APPARATUS FOR GENERATING POLLUTION FREE ELECTRICAL ENERGY FROM HYDROCARBONS

FIELD OF THE INVENTION

The present invention relates to electrical power generation, and more specifically substantially pollution free power generation obtained from naturally occurring hydrocarbons with the reinjection of waste byproducts into subterranean formations.

BACKGROUND OF THE INVENTION

As a result of worldwide industrialization in the 19th and 20th centuries and the discovery of the internal combustion engine, an ever increasing demand for hydrocarbon fuel exists throughout the world. More specifically, "hydrocarbons" as discussed herein include all carbon based combustible fuels such as coal, petroleum products such as oil and tar, and natural gas, and any organic compound of hydrogen and carbon which occurs naturally in gaseous, liquid or solid form and is generated through either biogenic or thermogenic means. Although extremely beneficial as a fuel source, these hydrocarbon energy sources emit toxic fumes and carbon containing compounds in their exhaust when burned, and are thus believed to be a major contributor to global warming, air pollution and other undesirable conditions known to cause harm to human health and the environment.

Although recent improvements to power generating exhaust systems including catalytic converters, exhaust scrubbers and other similar products have improved the efficiency and reduced emissions of power plants which rely on hydrocarbon fuel sources, there is still a significant problem with regard to how these toxic emissions from hydrocarbon fuels can be significantly reduced or eliminated.

In conjunction with the aforementioned problem of toxic and carbon containing gas emissions, an additional problem exists in producing and transporting hydrocarbon fuels from remote locations to existing electrical power plants located near high population densities. More specifically, significant numbers of hydrocarbons reservoirs, and more specifically natural gas fields are discovered in remote locations which are often hundreds of miles from a major city or power plant. Since the discovered reserves are not sufficient to justify the economic expense of a gas transmission pipeline, many of these smaller hydrocarbon reservoirs are never exploited, thus preventing the production of valuable energy resources from remote locations.

Thus, a significant need exists for an apparatus and method for exploiting hydrocarbon reservoirs in remote locations to provide cost effective, and substantially pollution free energy to local communities and municipalities.

SUMMARY OF THE INVENTION

It is thus one aspect of the present invention to provide a cost effective, economical apparatus and method to exploit and produce combustible products from hydrocarbon reservoirs and generate electrical energy in remote and isolated locations. Thus, in one embodiment of the present invention, produced natural gas from a subterranean formation is utilized to power an electrical generator which produces electrical energy for transmission through local power lines and grid systems.

It is a further aspect of the present invention to provide a method and apparatus for generating substantially pollution free energy from hydrocarbon reservoirs which contain oil and natural gas. Thus, in one embodiment of the present invention the exhaust byproducts from an engine used to drive an electrical generator is contained, scrubbed to remove water and other impurities, and reinjected into a subterranean formation to eliminate emissions of toxic and carbon containing exhaust gases to the atmosphere.

It is a further aspect of the present invention to provide an apparatus and method for improving in a cost effective manner the productivity of an existing hydrocarbon reservoir, which at the same time substantially eliminating toxic gases and exhaust byproducts from entering the atmosphere. Thus, in one aspect of the present invention the exhaust gases created during electrical generation are collected, compressed and reinjected into the producing hydrocarbon reservoir. The injection of the exhaust gases thus increases the reservoir pressure and enhances the production rate and ultimate recovery from the hydrocarbon reservoir.

Thus, in one embodiment of the present invention a method for creating substantially pollution free energy is provided, comprising the steps of:

a) producing hydrocarbon fluids from a subterranean formation;

b) separating non-combustible constituents from said hydrocarbon fluids;

c) generating electrical energy from said hydrocarbon fluids;

d) transmitting said electrical energy into a local electrical transmission line; and e) injecting a waste byproduct gas from said generating electrical energy step into at least one of said subterranean formation or a secondary subterranean formation.

DETAILED DESCRIPTION

Figure 1:
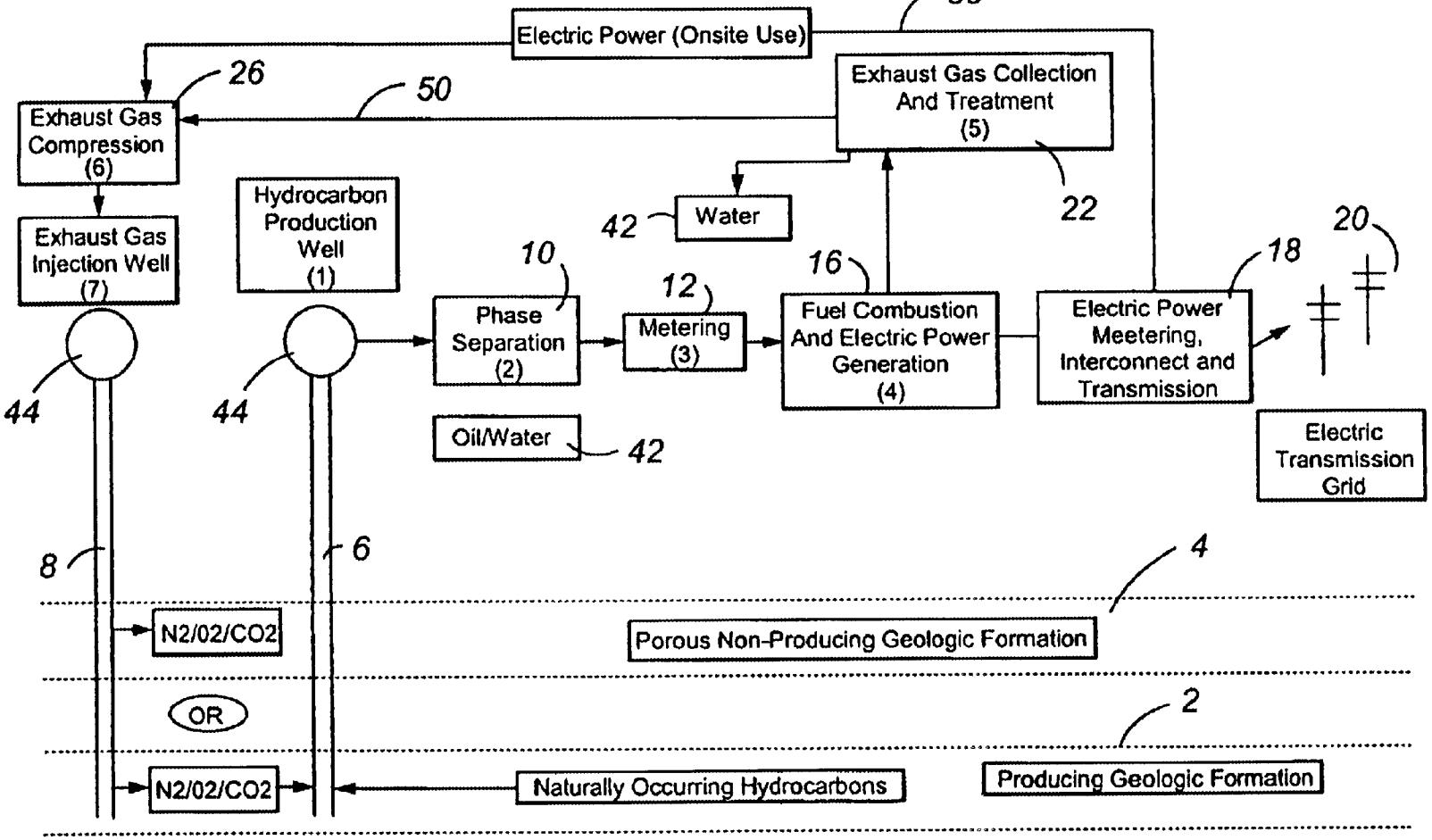
FIG. 1 is a flow schematic identifying one embodiment of the present invention and depicting a producing wellbore, process equipment, an injection wellbore and electrical power transmission lines.

Referring now to the drawings, FIG. 1 depicts a flow schematic of one embodiment of the present invention and which identifies the flow path of a hydrocarbon fluid and the creation of electrical energy associated therewith. More specifically, the flow schematic depicts a producing geologic formation 2 which generally comprises a porous and permeable subterranean formation which is capable of storing a hydrocarbon such as oil, natural gas, condensate, or other combustible hydrocarbons (hereinafter "hydrocarbon fluid"). The natural gas may be comprised of methane, ethane, butane, propane, as well as liquid condensate associated therein. As well known in the oil and gas industry, these hydrocarbon fluids may be produced through a producing wellbore 6 either naturally due to a high bottom hole pressure in the producing geologic formation, or by means of artificial lift using pumps, down-hole motors, sucker-rods, and other available means to extract the hydrocarbon fluids from the geologic formation to a surface location. Alternatively, the hydrocarbon fluids may be produced from buried landfills, or other non-naturally occurring man made deposits which generate combustible hydrocarbon fluids such as methane gas.

Upon production of the hydrocarbon fluids through the producing wellbore 6, the hydrocarbon fluids generally flow through a wellhead 44, which typically has a plurality of valves 38 and pressure gauges 40. The valves 38 or "choke bodies" generally restrict and regulate the pressure and flow rate of the hydrocarbon fluids. After flowing downstream from the wellhead 44, the hydrocarbon fluids generally enter a phase separator 10 which is used to separate the condensate liquid and gas components of the hydrocarbon fluid stream from any water which may be present in the fluid. The water is generally removed to a oil/water storage vessel 42, where it is transported via a truck to a secondary location and/or the water is treated and reinjected into a subterranean geologic formation.

Once the substantially water free hydrocarbon fluids exit the phase separator 10, the hydrocarbon fluids typically flows through a metering device 12 to identify the volume of dry gas or liquid condensates being produced. After discharge from the meter, the hydrocarbon fluids are used to run a reciprocating or turbine engine 14, which in turn drives an electrical generator 16 to produce electrical energy in the form of an electrical current.

As identified in FIG. 1, the electrical energy generated from the electric generator 16 may be transformed with an electric transformer 18 to modify the amount of voltage being introduced into the electric transmission grid 20. This electric transmission grid 20 is preferably an electrical power line which is located in close proximity to the producing wellbore, and thus reduces the significant costs involved with installing a gas utility pipeline for transmission of the natural gas to an electrical generating plant at a distant location, this process is generally known in the art as distributive power generation.

As further depicted in FIG. 1, the exhaust gas 50 generated from the engine 16 flows into an exhaust gas collection and treatment vessel 22 which is further used to treat the exhaust gas 50 and remove any water content and/or vapor associated therewith. The engine 16 is generally an internal combustion engine (IC), a combustion turbine engine (CT) or a reciprocating combustion engine (RC), which are well known by those skilled in the art. The water is removed to a secondary water storage vessel 42 where it is either reinjected into a subterranean formation or transported via a truck to a secondary location for treatment. The exhaust gas 50 produced from the turbine or reciprocating engine is now substantially dry and is piped to an exhaust gas compressor 26 which increases the pressure of the exhaust gas from a low of between about 0–50 psi to a high of 10,000 and 30,000 psi, the discharge pressure being determined by the pressure of the subterranean geologic formation used for injection purposes. Volumetric compression rates are from 10 actual cubic feet per minute ("acfm") to 10,000 acfm.

More specifically, the exhaust gas is compressed in the gas compressor 26 to a pressure which is sufficient to allow the exhaust gas 50 to be injected down an injection wellbore 8 (overcoming the friction pressure loss in the pipe) and into a subterranean formation which has a lower pressure.

Thus, the exhaust gas is injected through an injection wellbore 8 which is in operable communication with either a porous and permeable non-producing geologic formation 4, or the producing geologic formation 2 itself. In summary, FIG. 1 depicts an apparatus and process which utilizes produced hydrocarbon fluids to create electrical energy for transmission through an electrical grid system, and which reinjects any exhaust gas or other pollutants into either a secondary subterranean formation or the producing geologic formation to substantially eliminate any pollution created from the producing hydrocarbon fluids.

Figure 2:
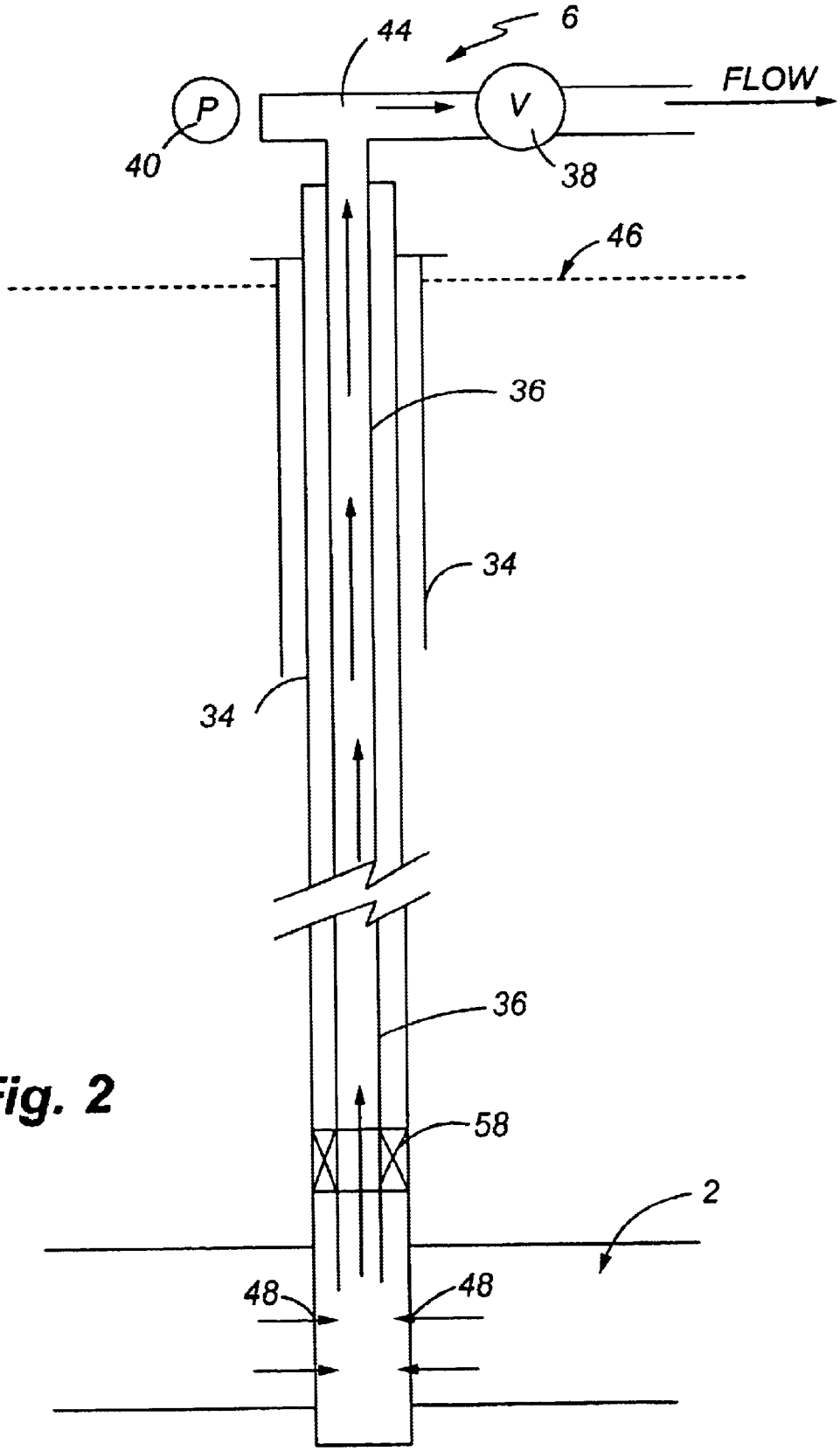
FIG. 2 is a front elevation view identifying a producing hydrocarbon wellbore and the various components associated therewith.

Referring now to FIG. 2, a front elevation view of a producing wellbore used in one embodiment of the present invention is provided herein. More specifically, FIG. 2 depicts a producing geologic formation 2 which is typically a porous and permeable sandstone or other rock formation capable of storing significant volumes of hydrocarbon fluids. Upon penetration of the geologic formation 2 by a producing wellbore 6, the producing wellbore is stabilized by running surface and production wellbore casing 34 to prevent earth materials from collapsing into the producing wellbore 6, and to isolate producing formations as necessary. To enhance production, the producing geologic formation may be "fractured" with high pressure fluids and supported with sand or other proppant materials to improve the relative permeability of the hydrocarbon reservoir and enhance production. Wellbore tubing 36 is subsequently lowered into the wellbore casing 34, and which provides a flow pathway for the hydrocarbon fluids produced from the producing geologic formation 2. The wellbore tubing 36 is generally isolated from the wellbore casing 34 by means of a packer 58, which provides a seal to isolate the producing formation and hydrocarbon fluids from the annulus and casing positioned above the packer 58.

To allow flow from the producing geologic formation 2 into the production casing 34 and production tubing 36, perforations 48 are provided which are generally a plurality of apertures positioned in the casing to provide communication from the producing geologic formation 2 and the wellbore production tubing 36. In a typical hydrocarbon fluid production operation, the bottom hole pressure of the producing geologic formation 2 is generally greater than the surface pressure, and the hydrocarbon fluids flow from the producing geologic formation 2 to the surface wellhead 44 which is otherwise known in the art as a "christmas tree". Preferably, a valve 38 is used to control the producing wellbore and thus regulate the flow rate and surface pressure. Numerous types of "chokes" and other valves are additionally well known in the art and can be made from a variety of different materials and designs. Upon flowing through the valve 38, the hydrocarbon fluids flow towards the process separator as shown in FIG. 3, and which may include oil, natural gas, and water.

Figure 3:
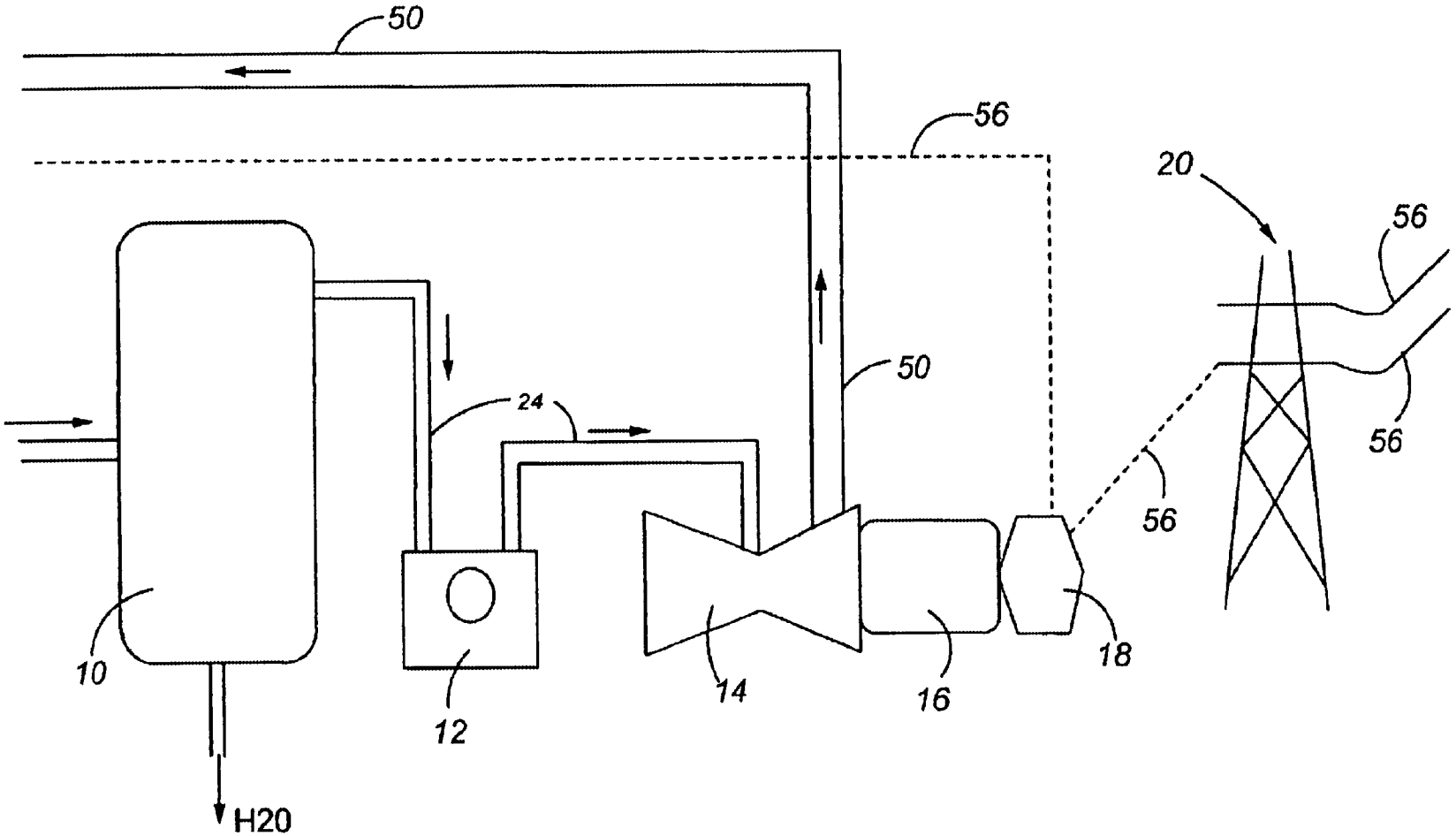
FIG. 3 is a flow schematic of process equipment utilized downstream from a producing wellbore in one embodiment of the present invention.

Referring now to FIG. 3, an equipment battery depicting one embodiment of the present invention is provided herein, and which identifies the various process equipment generally required to scrub i.e., clean the produced hydrocarbon fluids, create electrical energy, and transmit the electrical energy through an existing electrical transmission grid. More specifically, produced hydrocarbon fluids enter a phase separator 10 which is generally either two phase such as a "gun barrel" or three phase depending on the particular design. A two phase separator typically separates gas from liquids with a plurality of vanes or baffles, while a three phase separator separates gas from liquid and additionally the water component from the hydrocarbon fluids in the liquid phase. In either embodiment, the liquid phase i.e. typically water, is removed from one portion of the phase separator 10 by means of the baffles and gravity, while the dry natural gas flows downstream through a meter 12. As previously stated, the water from the phase separator 10 is either trucked to a secondary location, or reinjected into a subterranean formation.

Once the natural gas flows through the gas meter 12, the hydrocarbon fluids flow into a combustion engine 14 which creates sufficient horsepower to drive an electrical generator 16. The combustion engine may be a combustion turbine engine similar to aircraft turbofan engines, or heavy framed model with massive casings and rotors. Either type generally have a multi-fuel capability, and can be operated with natural gas or high quality hydrocarbon liquid distillates. The combustion may also be a reciprocating combustion engine 14 having numerous designs, and can again run on different types of hydrocarbon fluids. Although, reciprocating engines are generally more efficient than turbine engines, they generally generate higher levels of toxic emissions and noise and require greater maintenance.

The electrical generator 16 creates electrical current from a rotating shaft driven from the combustion turbine or reciprocating combustion engine 15, which is transformed into electrical power at a rate ranging from a low of 20 kW to a high of over 1000 kW. Electric power created by the generator is transmitted to a transformer 18 which converts the current to an output suitable for an electric line, generally 3 phase 480 volt. The electrical current is subsequently transmitted through an electrical transmission grid 20 which is typically located in close proximity to a small town or other community which utilizes the electrical current for household needs such as light and power generation, etc.

Both combustion turbine engines and reciprocating combustion engines utilize produced mechanical energy in the form of a rotating shaft to drive an electric generator in power rating sizes generally ranging from 20 to 500 kW although large heavy-farmed turbines can drive generators in excess of 1000 kW. These single shaft generator designs produce high frequency electric power at cycle speeds greater than 1000 Hz, which in turn is converted to high voltage DC current and then inverted back to 60 Hz current. Single-shaft turbine/generator designs mount the compressor, turbine, and electrical generator on a single shaft, which generally has only one major moving part. Dual-shaft designs require that a gearbox and associated moving parts be mounted between the turbine and the generator. Single-shaft systems require power electronics to convert high frequency generated power to standard 50 or 60 Hz power. Dual-shaft systems rely on gear reductions to regulate generator rotation speed to produce the desired standard frequency power.

Reciprocating combustion engine driven electric generators 16 range in size from lightweight, portable designs with an output of around 10 kW or less, to very large, low speed designs that can generate up to 25 MWe of electrical output. Typically, reciprocating combustion engines are classified as low speed (300–750 rpm), medium speed (750–1,200 rpm), and high speed (>1,200 rpm). The latter are more compact and lighter than low speed designs and are often used for emergency/back-up or peaking power with reduced operating hours. Low speed designs are typically used for baseload power applications due to their lower maintenance requirements. Combustion turbine driven electric generators extend in size from small micro turbines ranging in size from 30 to 80 kW, all the way up to very large, stationary designs that deliver up to 175 MWe in output in a simple cycle mode.

One technique for improving the efficiency and/or output from a combustion turbine is to recover some of the energy in the hot exhaust gases—commonly referred to as waste heat recovery. By directing the exhaust gases into a heat recovery steam generator high pressure steam can be generated to drive a steam turbine for additional electrical output. This is referred to as a combined cycle process because it is a combination of both a Brayton cycle (the air-gas working fluid of a combustion turbine) and a Rankine cycle (the water-steam working fluid used to drive the steam turbine). Alternatively, a waste heat recovery boiler can be used to generate hot water and/or low pressure steam that can be used for process heat in a commercial or industrial application.

Waste heat recovery is also commonly used with reciprocating combustion engine applications. In this process, hot water and low pressure steam can be generated by circulating water/antifreeze solutions through the engine block and oil cooling systems, or by installing heat exchangers in the exhaust gas path. The recovered heat can then be used in various industrial and commercial processes. An efficiency enhancement technique used for waste heat recovery on a combustion turbine engine is to utilize the energy in the exhaust to pre-heat the combustion air prior to entering the combustion zone. This improves the simple cycle efficiency and is accomplished via an air-gas heat exchanger called a recuperator. These devices are commonly used on micro turbines and small combustion turbines (less than 10 MWe), but become complex and cost prohibitive on larger designs, in part due to increases in operating pressures and the associated air gas sealing requirements of the recuperator.

Microturbines operate at low compression ratios (4–5:1) and firing temperatures, resulting in relatively low simple cycle efficiencies. When equipped with recuperators, simple cycle efficiencies between 20 and 28% (lower heating value—LHV) can be expected. Efficiencies for small to medium-sized simple cycle combustion turbines in the 500 to 25,000 kW size range typically vary between 25% to 35% LHV depending on pressure ratio and turbine inlet temperature. High pressure ratios and turbine inlet temperatures, achieved by using more exotic turbine blade materials and/or blade cooling technologies, results in higher efficiencies in the 35% to 40% range. Combined cycle applications boost the efficiency to levels in the 35% to 55% range. The efficiencies of combustion turbine driven power systems are dependent on temperature, with values increasing at lower ambient or compressor inlet temperature. Typical efficiencies for turbine engines vary between 25% and 40% (LHV).

There are numerous manufacturers of reciprocating combustion engine generators 16 in the U.S. and around the world. These include Caterpillar, Waukesha, Wartsila, Jenbacher, Cummins, Kohler, Cooper Bessemer, Fairbanks-Morse, Detroit Diesel, and General Motors. An example of Caterpillar's natural gas fired engine line is listed below:

| Model | kW Output | Speed |
|---|---|---|
| G3304 | 55–65 | High—1,800 rpm |
| G3306 | 85–150 | High—1,800 rpm |
| G3406 | 150–240 | High—1,800 rpm |
| G3408 | 175–310 | High—1,800 rpm |
| G3412 | 250–475 | High—1,800 rpm |
| G3508 | 210–395 | Medium—1,200 rpm |
| G3512 | 365–600 | Medium—1,200 rpm |
| G3516 | 465–820 | Medium—1,200 rpm |
| G3606 | 1,070–1,135 | Medium—900 rpm |
| G3608 | 1,430–1,515 | Medium—900 rpm |
| G3612 | 2,160–2,290 | Medium—900 rpm |
| G3616 | 2,880–3,050 | Medium—900 rpm |

Major manufacturers of micro turbines include Capstone (30 and 60 kW models), Ingersoll-Rand (70 kW), Elliott/Ebara (80 kW), Bowman, and Turbec. Manufacturers of larger turbine units include General Electric, Siemens-Westinghouse, Ahlstom, Solar (a division of Caterpillar), Rolls-Royce, Pratt-Whitney, US Turbine, Allison, Hitachi and Kawasaki. Solar's line of turbine generator sets, typical of the mid-range sizes used in distributed power applications, are listed below:

| Model | kW Output | Type |
|---|---|---|
| Saturn 20 | 1,210 | Simple Cycle |
| Centaur 40 | 3,515 | Simple Cycle |
| Mercury 50 | 4,600 | Recuperated |
| Centaur 50 | 4,600 | Simple Cycle |
| Taurus 60 | 5,200 | Simple Cycle |
| Taurus 70 | 6,890 | Simple Cycle |
| Mars 90 | 9,285 | Simple Cycle |
| Mars 100 | 10,685 | Simple Cycle |
| Titan 130 | 12,832 | Simple Cycle |

Figure 4:
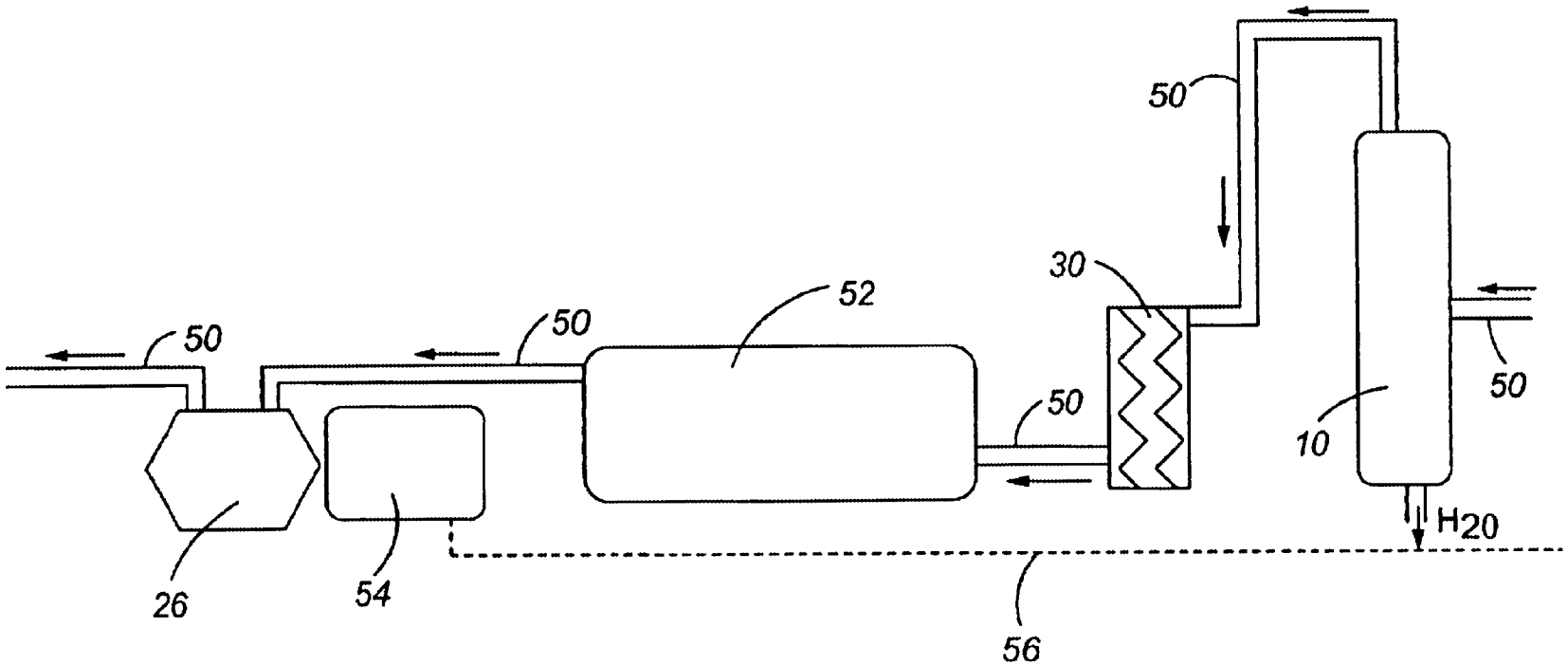
FIG. 4 is a flow schematic of additional process equipment related processing produced hydrocarbon and exhaust gases in one embodiment of the present invention.

The exhaust gas created from the turbine or reciprocating engine is subsequently piped though exhaust gas piping 50 for further treatment and injection as shown in FIG. 4. With regard to the electric power generation, there are generally 1) direct current generators and 2) alternating current generators as discussed herein:

A generator is fundamentally a magnet spinning inside a coil of wire. If a magnetic core, or armature, revolves between two stationary coils of wire called field poles an electric current is produced. This produced current in the armature moves in one direction during half of each revolution, and in the other direction during the other half. To produce current moving in only one direction it is necessary to provide a means of reversing the current flow outside the generator once during each revolution. In original generators this reversal was accomplished by means of a commutator, a split metal ring mounted on the shaft of the armature. The two halves of the ring were insulated from each other and served as the terminals of the armature coil. This was accomplished by having fixed brushes of metal or carbon being held against the a split metal ring as it revolves. As the armature turns, each brush is in contact alternately with the halves of the ring, changing position at the moment when the current in the armature coil reverses its direction producing a current flow in one direction, or direct current (DC). In modern DC generators this reversal is accomplished using power electronic devices such as diode rectifiers. DC generators have the advantage of delivering comparatively constant voltage under varying electrical loads over short line distances.

Like a DC generator an alternating current (AC) generator is a simple generator without a commutator which will produce an electric current that alternates in direction as the armature revolves. Alternating current is more efficient over long line electric power transmission distances. Due to this inherent efficiency most power generators in use today are of the AC type. Because it is often desirable to generate as high a voltage as possible, rotating armatures as found in simple AC generators are not practical because of the possibility of sparking between brushes and slip rings and the danger of mechanical failures that might cause short circuits. To eliminate this problem, AC generators known as alternators rises to a peak, sink to zero, drop to a negative peak, and rise again to zero numerous times each second at a frequency dependent on input shaft rotation speed. Single winding armatures produce single-phase alternating current while two windings produce two phase current and so on. A larger number of phases may be obtained by increasing the number of windings in the armature, but in modern electrical-engineering practice three-phase alternating current is most commonly used, and the three-phase alternator is the dynamoelectric machine typically employed for the generation of electric power.

A typical small-to-mid-sized combustion turbine that could be used for distributed power by an electric utility, or for on-site commercial or industrial power, is the Solar Taurus 60. This combustion turbine generator has a continuous output of 5,200 kWe and heat rating of 11,263 Btu/kW-hr. The exhaust temperature for this machine is 906° F. at standard conditions. The combustion turbine and generator come in a skid-mounted package with a length of 28 ft. and 8 ft. in height and a weight of approximately 65,000 pounds. The package includes an exhaust collector, turbine assembly, combustor, compressor, air inlet, gearbox, base frame, including fuel and oil systems, generators, starter, and microprocessor-based control system. The system may be purchased with an optional weather-resistant outdoor enclosure, fire protection system, inlet air filters and ducting, and outlet silencers and exhaust ducting. Along with this equipment, a complete installation will include natural gas or fuel delivery systems (piping, pressure regulation, metering, filtering, valving), substation equipment (step-up transformer, breakers, protective relaying, electrical metering equipment), foundations, compressor wash equipment, stack, perimeter fencing, and lighting. The site may also include a natural gas compressor (if required), distillate storage and transfer equipment, emissions control equipment (including stack analyzers), control room.

Upon creation of the desired electrical current from the electrical generators, an electrical transformer substage may be utilized. More specifically, several microturbine designs operate at very high speed (greater than 50,000 rpm) and are coupled to an electric generator on the same shaft. High frequency alternating current (AC) is converted to direct current (DC) via a rectifier, and then to 50 or 60 Hz AC power via an inverter. However, most combustion turbine electric generators, including one of the microturbine designs, use a gearbox between the power unit and the generators so that the generator rotates at 3,600 rpm (or a multiple of this) to produce 60 Hz AC power.

The most common electrical output for microturbines and small reciprocating engine generators is 3 phase, 480 volt power, although there are variations in this between manufacturers. Larger units typically produce 3 phase, 5 to 15 kilovolt power. In all cases, a step-up (or step-down) transformer will be required if the generators is to be connected to an electrical circuit or distribution system that operates at voltages different than these.

A large number of small industrial and commercial buildings are connected to a 3 phase, 480 volt power supply. In this instance, a microturbine with this output would not require a step-up transformer. Electric distribution lines typically operate at higher voltages. Examples would be 7.2 kV, 12.5 kV, 24.9 kV, 44 kV and 69 kV. Electric transmission lines operate at even higher voltages including 115 kV, 230 kV, 345 kV, 500 kV and higher. In all cases, transformers will be required if the voltage output of the electrical generator is different than the electrical circuit at the point of interconnection.

Electric generators that supply power to an isolated circuit are said to be operating in a stand-alone or grid-independent configuration. If the electric generators simultaneously supplies power to both a low voltage circuit (building or industrial process) and an electric distribution or transmission system, it is said to be operating in a grid-parallel mode. In the event of a loss (fault) on the electric distribution or transmission line, an automatic transfer switch can be used under the right circumstances to transfer power directly from the electric generators to the low voltage circuit.

The quantitative amount of electric power generated and transmitted is typically measured and recorded at the point of generation before being transmitted to the electric power grid for end user consumption. Electric meters/recorders are used not only to measure kilowatt-hours for the purpose of monetary compensation to the power generator but also for the measurement of volts, amperes, and other quantities for system diagnostics. Generator system interconnect meters typically measure peak, average, and minimum power generating values along with recording data on electric power frequency, quality, and resistance.

Upon generation of the electricity from the turbine or reciprocating engine 14, electric generator 16 and electric transformer 18, the electrical current must be compatible for transmission into an existing electrical line grid 56. More specifically, the lines of high-voltage transmission systems are usually composed of wires of copper, aluminum, or copper-clad or aluminum-clad steel, which are suspended from tall latticework towers of steel by strings of porcelain insulators. By the use of clad steel wires and high towers, the distance between towers can be increased, and the cost of the transmission line thus reduced. In modern installations with essentially straight paths, high-voltage lines may be built with as few as six towers to the mile. In some areas high voltage lines are suspended from tall wooden poles spaced more closely together. For lower voltage subtransmission and distribution lines, wooden poles are generally used rather than steel towers. In cities and other areas where open lines create a hazard, insulated underground cables are used for distribution. Some of these cables have a hollow core through which oil circulates under low pressure. The oil provides temporary protection from water damage to the enclosed wires should the cable develop a leak. Pipe-type cables in which three cables are enclosed in a pipe filled with oil under high pressure (14 kg per sq cm/200 psi) are frequently used. These cables are used for transmission and subtransmission of current at voltages as high as 3465,000 V (or 345 kV).

Long transmission lines have considerable inductance and capacitance. When a current flows through the line, inductance and capacitance have the effect of varying the voltage on the line as the current varies. Thus, the supply voltage varies with the load. Several kinds of devices are used to overcome this undesirable variation, in an operation called regulation of the voltage. The devices include induction regulators and three-phase synchronous motors (called synchronous condensers), both of which vary the effective amount of inductance and capacitance in the transmission circuit. Inductance and capacitance react with a tendency to nullify one another. When a load circuit has more inductive than capacitive reactance, as almost invariably occurs in large power systems, the amount of power delivered for a given voltage and current is less than when the two are equal. The ratio of these two amounts of power is called the "power factor". Because transmission-line losses are proportional to current, capacitance is added to the circuit when possible, thus bringing the power factor as nearly as possible to 1. For this reason, large capacitors are frequently inserted as a part of power-transmission systems.

Modern electric power grid systems use transformers to convert electricity into different voltages. With transformers, each stage of the system can be operated at an appropriate voltage. In a typical system, the generators at the power station deliver a voltage from about 1,000 to 26,000 volts (V). Transformers step this voltage up to values ranging from 138,000 to 765,000 V for the primary transmission line. At the substation, the voltage may be transformed down to levels of 69,000 to 138,000 V for further transfer on the subtransmission system. Another set of transformers step the voltage down again to a distribution level such as 2,400 or 4,160 V or 15, 27, or 33 kilovolts (kV). Finally the voltage is transformed once again at the distribution transformer near the point of use to 240 or 120 V.

Referring now to FIG. 4, the exhaust gas 50 is shown being processed and reinjected with additional process equipment needed in one embodiment of the present invention. More specifically, the exhaust gas piping 50 is operably interconnected to a subsequent two phase separator 10 which removes any vapor and/or water content from the exhaust gas. The piping is preferably high temperature resistant materials which are specifically designed for high temperature applications. The separator 10 maybe a dehydration vessel with coalescing elements in one compartment and a knitted wire mesh mist extractor in a second compartment. These types of vessels are well known in oil and gas industry and are manufactured by companies such as Anderson, Van Air, J. L. Bryan, Process Equipment Co. and Wright-Austin.

The vapor or water removed from the exhaust gas is subsequently reinjected into a subterranean formation and/or placed in the storage tank for removal at a later date. The exhaust gas exits the phase separator 10 and subsequently enters into a heat exchanger/cooler which additionally removes any impurities from the exhaust gas and/or creates condensation to remove additional water content. One example of such a device is a blazed or aluminum heat exchanger to cool the gas to allow efficient compressor operation. These types of coolers are manufactured by companies such as Lytron, Fafco, Sewep, Power Equipment and Hydro Thrift. The remaining cooled and dry exhaust gas is then piped to a low pressure exhaust gas storage reserve vessel which may be used to store static volumes of between about 6,000 scf and 60,000 scf of exhaust gas as desired.

The exhaust gas storage vessel 52 is in operable communication with a gas compressor 26, which may be driven by an electric motor 54 which obtains the electrical energy from the electric generator which is being run by the produced hydrocarbon fluids. The gas compressor 26 is generally used to increase the exhaust pressure from between about atmospheric pressure and 2.5 psi to about 420 and 5000 psi depending on the downhole reservoir pressure of the subterranean formation in which the gas is intended to be injected. Thus, the size and horsepower required for the compressor 26 is dictated by the bottom hole pressure of the subterranean formation utilized for reinjection purposes.

Compressors are designed to increase the pressure and decrease the volume of a gaseous fluid. The three general types currently in manufacture are 1) positive-displacement, 2) dynamic, or 3) thermal types. Positive displacement compressors fall into two basic categories including 1) reciprocating and 2) rotary. Reciprocating compressors consist of one or more cylinders each with a piston or plunger that moves back and forth, displacing a positive volume of gas with each stroke. Rotary compressors types are either lobe, screw, vane or liquid ring, with each having a casing with one or more rotating elements that either mesh with each other such as lobes or screws, or that displace a fixed volume with each rotation. Dynamic type compressors include radial-flow, axial-flow and mixed flow machines which are all rotary continuous flow compressors in which rotating elements (impellers or blades) accelerate the gas as it passes through the element. Thermal "ejector" compressors use a high velocity gas or stream jet to entrain an inflowing gas, then convert the velocity of the mixture to pressure in a diffuser. Reciprocating (positive displacement) compressors, which makeup the majority type for oil and gas applications, have horsepower ratings that vary from fractional to more than 20,000 hp per unit. Pressure ranges from low vacuum at suction to 30,000 psi and higher at discharge with inlet flow volumes ranging from less than 10 cubic feet/minute (cfm) to over 10,000 cfm. Reciprocating compressors are supplied in either single-stage or multi-stage configurations depending on the overall compression ratio needed. The compression ratio per stage is generally limited by the discharge temperature and usually does not exceed 4:1, although some small sized units are furnished with compression ratios as high as 8:1. On multistage machines, intercoolers may be installed between stages to remove the heat of compression from the gas and reduce its temperature resulting in overall higher efficiencies. Reciprocating compressors should be supplied with clean gas as they cannot handle liquids and solid particles that may be entrained in the inlet gas. Compressor types and flow ratings to be unutilized for exhausted gas compression for subterranean injection is dependent on the producing well(s) outlet flow rate to the combustion generators, combustion engine types and number, exhaust flow rates and cooling efficiencies. Some current manufacturers of compressors for oil and gas facility applications include Ariel, Atlas, Copco, Cooper, Dresser-Rand, Gardner Denver, Gemini, Howden, Mycom, Neuman & Esser, Rix and Sundyne. Compressors and drive engines/motors are generally sold as modular units where all the various components are located on one skid or truck mounted unit. Modular compressor units can be obtained for any application from low pressure to high pressure. Some currently available compressor/drive engine modules include the Caterpillar G379TA/Knight KOA-2, Superior 6GTLB/Superior MW-62, Ajax DPC-230/Single Stage, Waukesha VRG301/Ariel JGP 1–2, and Waukesha 817/Inight KOA-2. Compressor induction exhaust gas flow rates by constituent in lbs/hr for a 75 kW combustion turbine generator engine:

| | |
|---|---|
| O2 | 1407 |
| N2 | 5370 |
| CO2 | 87 |
| NOx | 0.03 |
| CO | 0.02 |

Compressor induction exhaust gas flow rates by constituent in lbs/hr for a 250 kW combustion turbine generator engine:

| | |
|---|---|
| O2 | 4213 |
| N2 | 16079 |
| CO2 | 261 |
| NOx | 0.06 |
| CO | 0.07 |

Figure 5:
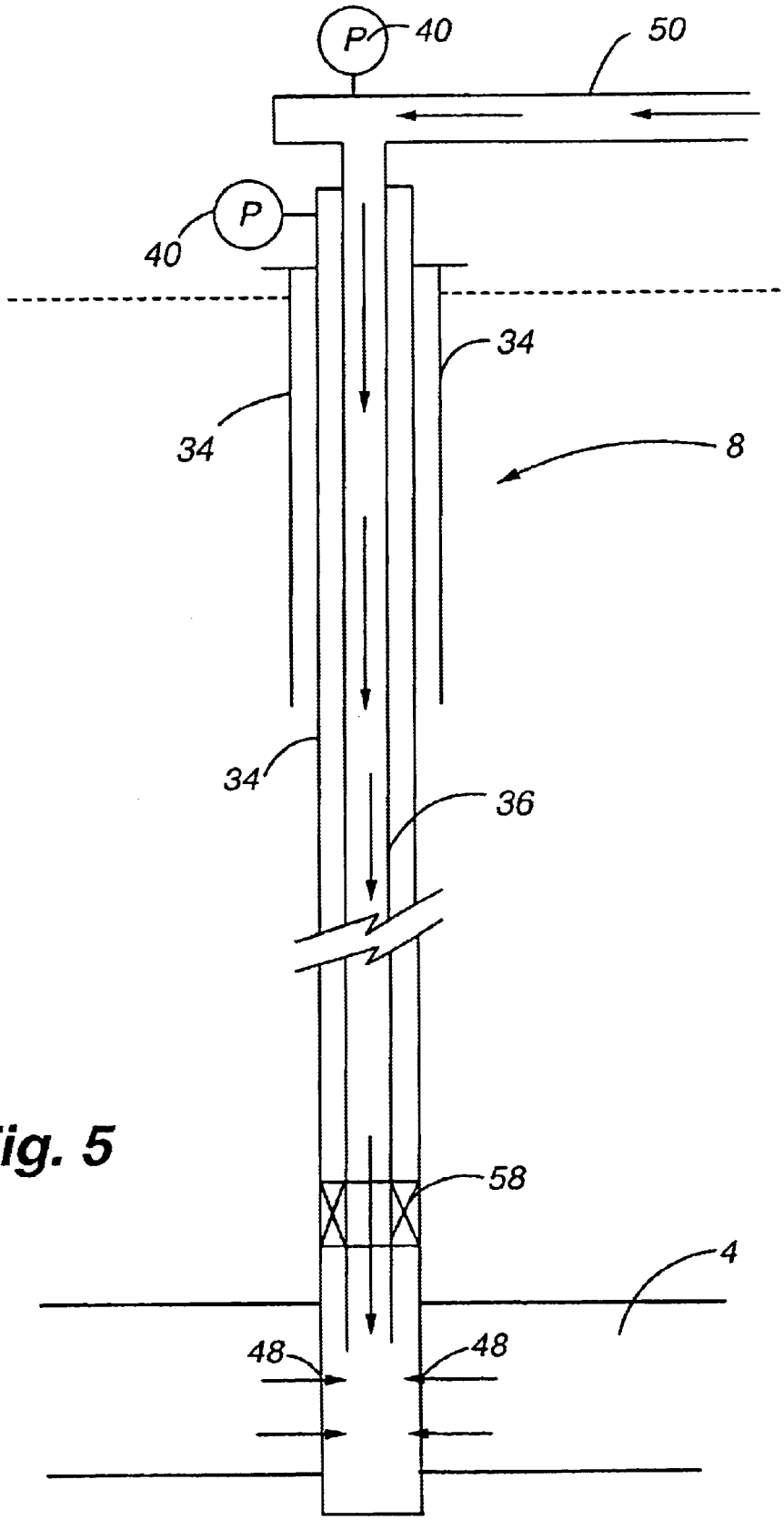
FIG. 5 is a front elevation view of an injection wellbore in one embodiment of the present invention and depicting the injection of waste gas into a subterranean formation.

Referring now to FIG. 5, a typical injection wellbore 8 of the present invention is provided herein. More specifically, the compressed exhaust gas which exits the compressor is operatively piped via exhaust gas piping 50 to a wellhead of an injection wellbore 8. The injection wellbore may again include pressure gauges 40 and other valves 38 to regulate the flow and/or back pressure of the injection wellbore 8 positioned downstream from the gas compressor 26. In the embodiment shown in FIG. 5, the injection wellbore 8 comprises wellbore tubing 36 which is positioned between two or three strings of wellbore casing 34 which protects the wellbore from the surrounding earth materials and to prevent any unwanted communication of produced fluids. The production tubing 36 is isolated from the wellbore casing 34 by means of a packer 58, which prevents communication of the injected exhaust gas to the wellbore casing 34. The wellbore casing 34 additionally has a plurality of perforations 48 positioned opposite the non-producing geologic formation 4 and which allows the injected exhaust gas to flow from the exhaust gas piping 50 through the injection wellbore 8 and into the non producing geologic formation 4.

As appreciated by one skilled in the art, in a further embodiment of the present invention the exhaust gas may be injected into a currently producing geologic formation 2 to enhance the ultimate recovery of the hydrocarbon fluids since the bottom hole pressure is increased. Depending on the bottom hole pressure of the existing producing geologic formation 2, and the availability of other non-producing geologic formations 4, the operator may determine whether or not to utilize the producing geologic formation 2 and/or utilize a non producing geologic formation 4 for injection purposes. On some occasions, the exhaust gas maybe injected in both a non-producing geologic formation 4 and a producing geologic formation 2 simultaneously as engineering principles and economics dictate.

Figure 6:
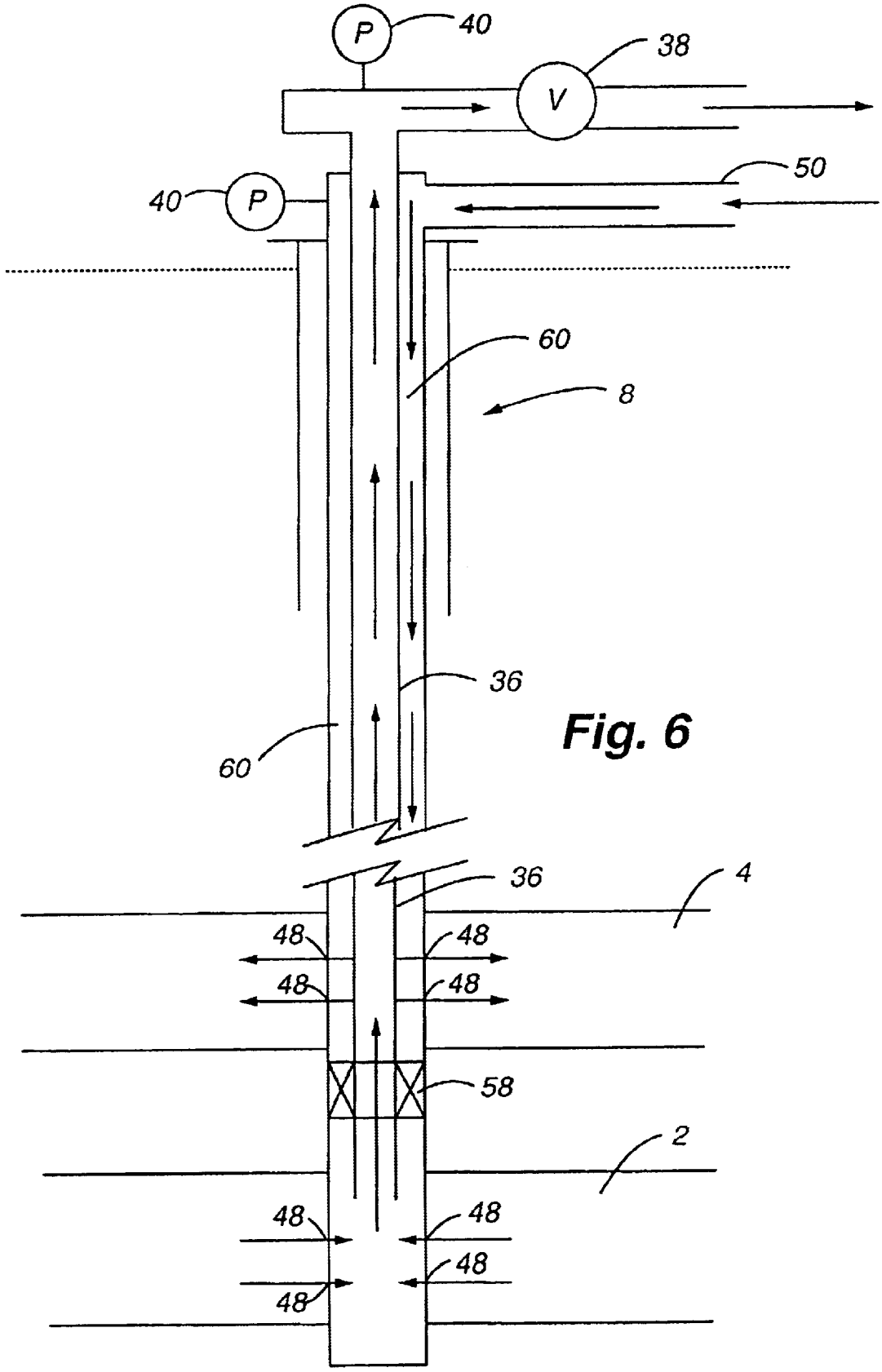
FIG. 6 is a front elevation view of a combined production and injection wellbore which depicts the production of hydrocarbon fluids from production tubing and the reinjection of exhaust gas into a second non-producing subterranean formation through the annulus defined by the production tubing and production casing.

Referring now to FIG. 6, one alternative embodiment of the present invention is shown herein, wherein the same wellbore is utilized for both production and injection purposes. More specifically, the producing geologic formation 2 is shown on the lower portion of the drawing, while a non-producing geologic formation 4 is shown positioned above at a shallower depth. Thus, the hydrocarbon fluids are produced from the producing geologic formation 2 into the production tubing 36 and subsequently through the wellhead, into the phase separator 10 and other process equipment. After treatment of the hydrocarbon fluids and subsequent generation of electrical energy, the exhaust gas is returned to the wellbore via exhaust gas piping 50 and is injected through the production casing/production tubing annulus 60 through the perforations 48 and into the non producing geologic formation 4.

Thus, in this particular example the produced hydrocarbon fluids flow through the production tubing 36, while waste exhaust gas is reinjected into the wellbore casing/production tubing annulus 60 and reinjected into the non-producing geologic formation 4. Thus, one producing wellbore can be utilized for both production and injection purposes, provided that at least one producing geologic formation 2 is located at a greater depth from a non producing geologic formation 4. As appreciated by one skilled in the art, depending on the various geologic formations and available downhole wellbore designs, any variety of combinations of injection and/or production scenarios may be utilized to accomplish the scope of the present invention.

For clarity purposes, the following list of the components and the numbering associated therein in the drawings is provided herein:

| Number | Component |
|---|---|
| 2 | Producing geologic formation |
| 4 | Non producing geologic formation |
| 6 | Producing Wellbore |
| 8 | Injection wellbore |
| 10 | Phase separator |
| 12 | Meter |
| 14 | Turbine or reciprocating engine |
| 16 | Electric generator |
| 20 | Electric transmission grid |
| 22 | Exhaust gas treatment vessel |
| 24 | Piping |
| 26 | Gas compressor |
| 28 | Gas storage vessel |
| 30 | Heat exchanger/cooler |
| 32 | Gas scrubber/cleaner |
| 34 | Wellbore casing |
| 36 | Wellbore tubing |
| 38 | Valve |
| 40 | Pressure gauge |
| 42 | Oil/water storage vessel |
| 44 | Wellhead |
| 46 | Ground surface |
| 48 | Perforations |
| 50 | Exhaust gas piping |
| 52 | Exhaust gas storage vessel |
| 54 | Electric motor |
| 56 | Electric line |
| 58 | Wellbore packer |
| 60 | Production casing/tubing annulus |

The foregoing description of the present invention has been presented for purposes of illustration and description. The description is not intended to limit the invention to the form disclosed herein. Consequently, the invention and modifications commensurate with the above teachings and skill and knowledge of the relevant art are within the scope of the present invention. The preferred embodiment described above is also intended to explain the best mode known of practicing the invention and to enable others skilled in the art to utilize the invention in various embodiments and with the various modifications required by their particular applications for use of the invention. It is intended that the claims be construed to include all alternative embodiments as permitted by the prior art.

What is claimed is:

1. A method for generating substantially pollution free electrical power from a hydrocarbon wellbore for use in a local electrical transmission grid, comprising the steps of:

a) producing hydrocarbon fluids from a subterranean formation to a surface location;

b) separating non-combustible constituents from said hydrocarbon fluids and said surface location, wherein water is substantially removed from said hydrocarbon fluids;

c) generating electrical energy from said hydrocarbon fluids substantially onsite in the vicinity of the wellbore;

d) transforming said electrical energy from a first voltage to a second voltage which is compatible with a local electrical transmission line;

e) transmitting said electrical energy into said local electrical transmission line which is located between an offsite electrical power generating facility and an end user; and f) injecting a waste byproduct exhaust gas from said generating electrical energy substantially onsite step into at least one of said subterranean formation or a secondary subterranean formation.

2. The method of claim 1, further comprising the step of metering said hydrocarbon fluids prior to said generating electrical energy step.

3. The method of claim 1, wherein the pressure in said subterranean formation is enhanced by injecting said waste byproducts into the subterranean formation.

4. The method of claim 3, wherein said injecting a waste byproduct gas step comprises compressing said waste byproduct gas from a low pressure to a high pressure which exceeds the pressure of said subterranean formation or said secondary subterranean formation.

5. The method of claim 1, further comprising the step of injecting said separated non-combustible constituents into a subterranean formation.

6. The method of claim 1, further comprising the step of separating water and other liquid phase byproducts from said waste byproducts prior to said injecting step.

7. The method of claim 1, wherein said transmitting said electrical energy step comprises interconnecting a conductive electrical line between a generator to said local electrical transmission line.

8. The method of claim 1, wherein said hydrocarbon wellbore is used for both the production of said hydrocarbons and the injection of waste byproduct gas.

9. The method of claim 8 wherein a production packer is positioned within said hydrocarbon wellbore to isolate the subterranean formation from the secondary subterranean formation.

10. The method of claim 1, further comprising the step of gathering substantially all waste byproduct exhaust gases prior to said injecting step, wherein said facility emits substantially no gas or exhaust into the atmosphere.

11. The method of claim 1, further comprising the step of metering said electrical energy prior to said transmitting electrical energy step, wherein a total accounting of the electrical energy transmitted may be determined.

12. A method for generating substantially pollution free electrical energy for local distribution and use from an isolated, stand alone hydrocarbon source, comprising the steps of:

a) providing a wellbore which extends from a surface location to a subterranean formation which contains hydrocarbons;

b) producing the hydrocarbons from the subterranean formation to the surface location;

c) separating non-combustible water constituents from said hydrocarbons at said surface location;

d) operating an engine at least partially with said hydrocarbons to generate electrical energy substantially onsite in the vicinity of the wall bore and create a first waste exhaust gas;

e) transmitting said electrical energy into an electrical transmission line which is located between an offsite electrical power generating facility and an end user;

f) metering said electrical energy which is generated substantially onsite to provide an accounting of the electrical energy transmitted;

g) scrubbing said waste exhaust gas to substantially remove water from said waste exhaust gas;

h) compressing said waste exhaust gas to increase a pressure of said waste exhaust gas;

i) capturing a second waste exhaust gas from said compressing step;

j) injecting said first waste exhaust gas and said second exhaust gas into the subterranean formation or a secondary formation, wherein substantially no waste exhaust gas from said ooerating an engine and compressing said waste exhaust gas steps is discharged into the atmosphere.

13. The method of claim 12, wherein said wellbore which produces said hydrocarbons is further utilized for the injection of said waste exhaust gas.

14. The method of claim 12, further comprising the step of injecting said water separated from said hydrocarbons into a subterranean formation.

15. The method of claim 12, further comprising the step of storing said waste exhaust gas in a storage vessel prior to said step of injecting said waste exhaust gas.

16. The method of claim 12, wherein said step of providing a wellbore comprises drilling a well into said subterranean formation and running at least one string of production piping to facilitate the extraction of said hydrocarbons.

17. The method of claim 12, wherein said step of providing a wellbore comprises utilizing a pre-existing wellbore which penetrates said subterranean formation.

18. The method of claim 12, wherein said separating step comprising flowing said hydrocarbons and said non-combustible water constituents through at least one vessel which utilizes in part a gravitational force to separate said hydrocarbons and said non-combustible water constituents.

19. The method of claim 12, wherein said transmitting said electrical energy step further comprises providing a transformer to selectively alter the amount of voltage associated with said electrical energy.

20. A method for exploiting a hydrocarbon reservoir in a remote location without producing exhaust gas byproducts to the atmosphere while providing electrical power to a local electrical transmission grid, comprising the steps of:

a) providing a wellbore which extends from a surface location to the hydrocarbon reservoir positioned below the earth's surface;

b) extracting a produced hydrocarbon from said hydrocarbon reservoir to said surface location;

c) removing any non-volatile constituent parts from said produced hydrocarbon at the surface location;

d) utilizing said produced hydrocarbon to generate electrical energy at the remote location;

e) transforming said electrical energy from a first voltage to a second voltage which is compatible with said local electrical transmission line.

f) transmitting said electrical energy into a local electrical transmission line which is located between an offsite electrical power generating facility and an end user; and g) injecting a waste exhaust gas created from generating said electrical energy at said remote location into said hydrocarbon reservoir or a secondary subterranean formation, wherein substantially no waste exhaust gas is emitted into the atmosphere.

* * * * *